US008558126B2

(12) United States Patent
An

(10) Patent No.: US 8,558,126 B2
(45) Date of Patent: Oct. 15, 2013

(54) ROTATION PIN CORRECTION MECHANISM FOR FOUR POLES MOLD CASED CIRCUIT BREAKER

(75) Inventor: Byeong Su An, Chungcheongbuk-Do (KR)

(73) Assignee: LS Industrial System Co., Ltd., Anyang-Si, Gyeonggi-Do (KR)

( * ) Notice: Subject to any disclaimer, the term of this patent is extended or adjusted under 35 U.S.C. 154(b) by 285 days.

(21) Appl. No.: 12/960,401

(22) Filed: Dec. 3, 2010

(65) Prior Publication Data

US 2011/0132733 A1 Jun. 9, 2011

(30) Foreign Application Priority Data

Dec. 4, 2009 (KR) ..... 10-2009-0119989

(51) Int. Cl.
*H01H 1/20* (2006.01)
*H01H 9/20* (2006.01)
*H01H 9/26* (2006.01)

(52) U.S. Cl.
USPC ..... 200/50.32; 218/154; 335/8; 335/10; 335/156

(58) Field of Classification Search
USPC ..... 200/17 R, 50, 32
See application file for complete search history.

(56) References Cited

U.S. PATENT DOCUMENTS

| | | | | |
|---|---|---|---|---|
| 6,369,340 | B1 * | 4/2002 | Castonguay et al. | 200/244 |
| 8,207,459 | B2 * | 6/2012 | Bae | 200/50.32 |
| 2007/0075047 | A1 | 4/2007 | Oh | |
| 2007/0075808 | A1 | 4/2007 | Ahn | |

FOREIGN PATENT DOCUMENTS

| | | |
|---|---|---|
| CN | 1364302 | 8/2002 |
| CN | 1945774 | 4/2007 |
| CN | 1945775 | 4/2007 |
| JP | 6028961 | 2/1994 |
| JP | 2000164106 | 6/2000 |
| JP | 2006108106 | 4/2006 |
| JP | 2007103374 | 4/2007 |
| JP | 2007103376 | 4/2007 |
| WO | 01/67473 | 9/2001 |

OTHER PUBLICATIONS

The State Intellectual Property Office of the People's Republic of China Application Serial No. 201010579112.9, Office Action dated Jan. 16, 2013, 6 pages.

* cited by examiner

*Primary Examiner* — Kyung Lee
*Assistant Examiner* — Lheiren Mae Caroc
(74) *Attorney, Agent, or Firm* — Lee, Hong, Degerman, Kang & Waimey

(57) ABSTRACT

Provided herein is a mechanism for correcting the deformation generated at a portion of the rotation pin between a single pole unit farthest away from a switching mechanism and a single pole unit adjacent thereto, and there is disclosed a correction plate provided at a portion of the pair of rotation pins located between a single pole unit farthest away from the switching mechanism and a single pole unit adjacent thereto, having a pair of rotation pin through hole portions to allow the pair of rotation pins to be penetrated, respectively, and a pair of adjustment extending portions extended in the direction in which the rotation pins penetrate at the upper or lower portion of the rotation pin through hole portions to determine the height of penetration allowance hole of the rotation pins together with the rotation pin through hole portions.

7 Claims, 5 Drawing Sheets

ROTATION PIN CORRECTION MECHANISM FOR FOUR POLES MOLD CASED CIRCUIT BREAKER

CROSS-REFERENCE TO A RELATED APPLICATION

Pursuant to 35 U.S.C. §119(a), this application claims the benefit of earlier filing date and right of priority to Korean Application No. 10-2009-0119989, filed on Dec. 4, 2009, the contents of which is incorporated by reference herein in its entirety.

BACKGROUND OF THE INVENTION

1. Field of the Invention

The present invention relates to a four poles mold cased circuit breaker, and more particularly, to a rotation pin correction mechanism for the four poles mold cased circuit breaker.

2. Description of the Conventional Art

Four poles mold cased circuit breaker is a mold cased circuit breaker capable of connecting an electric line of neutral pole (neutral phase) (hereinafter, abbreviated as "N" pole) as a ground pole in addition to the electric lines for three alternating currents having a phase difference, i.e. R, S, and T three poles (phases) in a mold cased circuit breaker.

In general, a mold cased circuit breaker is configured by accommodating a trip mechanism for detecting the generation of an abnormal current on a circuit in an enclosure with a synthetic resin material having electric insulation characteristics, a switching mechanism which provides means for an electric circuit to be manually switched by handle manipulation or can provide a driving force for automatic trip operation of the circuit through triggering by the trip mechanism, and an arc extinguishing mechanism for extinguishing an arc generated between contacts during trip operation.

Furthermore, typically, a mold cased circuit breaker may include a movable contactor and a stationary contactor provided with a contact, an arc extinguishing mechanism, and a trip mechanism for each pole.

Here, insulating partition walls are formed within the enclosure to electrically insulate between poles (in other words, between phases), thereby preventing a short circuit from being generated between the relevant mechanisms for each pole.

For recent mold cased circuit breakers, many manufacturers employ a method in which a so-called single pole unit is configured therein by accommodating the movable contactor and stationary contactor, arc extinguishing mechanism, and trip mechanism provided for each pole into insulating cases, respectively, separately from the enclosure to be sealed from the outside with intention to enhance productivity and convenience of maintenance by reinforcing electric insulation between the poles and promoting the modularization of mechanisms.

A four poles mold cased circuit breaker is provided with total four single pole units since the single pole unit is provided for each pole, and one switching mechanism for manually switching or trip-driving the relevant single pole units in common is provided at an upper portion of the single pole unit for the S pole (S phase) among the single pole units for R, S, T, and N poles.

Furthermore, a pair of rotation pins connected through links to transmit driving power from a switching mechanism are used to transmit driving power for switching a circuit from the switching mechanism to single pole units, respectively, at the same time. Such a pair of rotation pins are formed lengthways to be connected through shafts at an inner portion of each single pole unit, and those shafts are supported to be rotatably driven by a rotation pin and revolved together with the movable contactor.

According to the configuration of such a four poles mold cased circuit breaker, referring to FIG. 6, the driving force imposed to a rotation axis 2*a*, 2*b* located at a portion of the N-pole single pole unit farthest away from the switching mechanism is weakened and the force imposed to a rotation axis 2*a*, 2*b* by a contact force between contacts is same, thereby causing deformation that the rotation axis 2*a*, 2*b* is bent in the direction of a force imposed to the rotation axis 2*a*, 2*b* by a contact force between contacts.

The deformation of such a rotation axis 2*a*, 2*b* causes switching operation failure of the N-pole single pole unit, and as a countermeasure to this, the applicant of the present invention has proposed a correction device with a rotation pin as disclosed in Korean Patent Registration No. 10-0689324 (Title of the Invention: Multi-poles mold cased circuit breaker)

The related art of the patent registration has a technical spirit that is configured with upper and lower blocks for inserting a rotation pin therebetween and a screw and a nut for pressing the upper and lower blocks to simply correct the deformation of a rotation pin by fastening a screw. However, it was a method of manually fastening a screw to make correction, thereby causing a problem that the relevant portion of a rotation pin may be over-deformed to act as a load preventing the contact between contacts and damage the upper and lower blocks when the screw fastening force is excessive, and the contact between contacts cannot be made or may be poor in the N-pole single pole unit when the screw fastening force is insufficient. In other words, the related art has a first problem that the correction amount is not uniform. Furthermore, the related art has a second problem that it may not be applicable when a space between the single pole units is narrow since it has a configuration in which the upper and lower blocks having a thickness and a screw and a nut are used.

SUMMARY OF THE INVENTION

Accordingly, the present disclosure is to solve the foregoing problem in the related art, and the objective of the present disclosure is to provide a rotation pin correction mechanism for a four poles mold cased circuit breaker, which the correction amount is uniform and is applicable even in case where a space between the single pole units is narrow.

The objective of the present disclosure may be accomplished by providing a rotation pin correction mechanism for a four poles mold cased circuit breaker having four single pole units for four poles provided with a movable contact and a stationary contact, respectively, a pair of rotation pins commonly connected to the four single pole units for four poles to switching all the single pole units at the same time, and a switching mechanism connected to drive the rotation pins, the mechanism comprising:

a correction plate provided at a portion of the pair of rotation pins located between a single pole unit farthest away from the switching mechanism and a single pole unit adjacent thereto, having a pair of rotation pin through hole portions to allow the pair of rotation pins to be penetrated, respectively, and a pair of adjustment extending portions extended in the direction in which the rotation pins penetrate at the upper or lower portion of the rotation pin through hole portions to determine the height of penetration allowance hole of the rotation pins together with the rotation pin through hole portions.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The objective of the present invention, as well as the configuration and working effect thereof to accomplish the foregoing objective will be clearly understood by the following description for the preferred embodiments of present disclosure with reference to the accompanying drawings.

Figure 1:
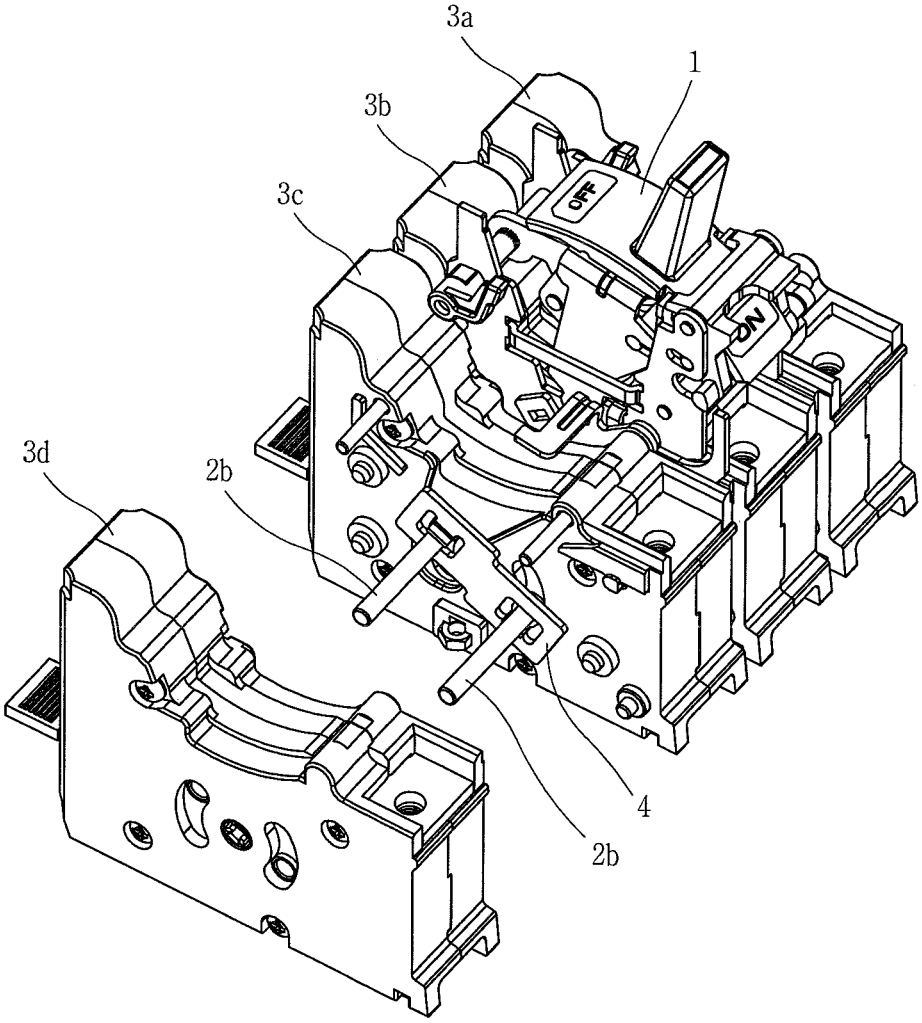
FIG. 1 is a perspective view illustrating a configuration in which a single pole unit of the neutral pole in a four poles mold cased circuit breaker is separated from rotation pins to illustrate a configuration in which a rotation pin correction mechanism for the four poles mold cased circuit breaker according to the present disclosure is provided at a portion of the rotation pins between a single pole unit of the neutral pole and a single pole unit of the adjacent pole.

Referring to FIG. 1, a four poles mold cased circuit breaker provided with a rotation pin correction mechanism according to a preferred embodiment of the present disclosure may include single pole units of four poles 3*a*, 3*b*, 3*c*, 3*d*, a pair of rotation pins 2*a*, 2*b*, and a switching mechanism 1.

The single pole units of four poles 3*a*, 3*b*, 3*c*, 3*d* may include a R-pole single pole unit (namely, R-phase single pole unit) 3*a*, an S-pole single pole unit (namely, S-phase single pole unit) 3*b*, a T-pole single pole unit (namely, T-phase single pole unit) 3*c*, and an N-pole single pole unit (namely, N-phase single pole unit) 3*d*, each of the single pole units 3*a*, 3*b*, 3*c*, 3*d* may include a movable contactor and a stationary contactor.

Referring to FIG. 1, a pair of rotation pins 2*a*, 2*b* are rotation driving pins commonly connected to the single pole units of four poles 3*a*, 3*b*, 3*c*, 3*d* to switch the single pole units of four poles 3*a*, 3*b*, 3*c*, 3*d* at the same time.

Figure 5:
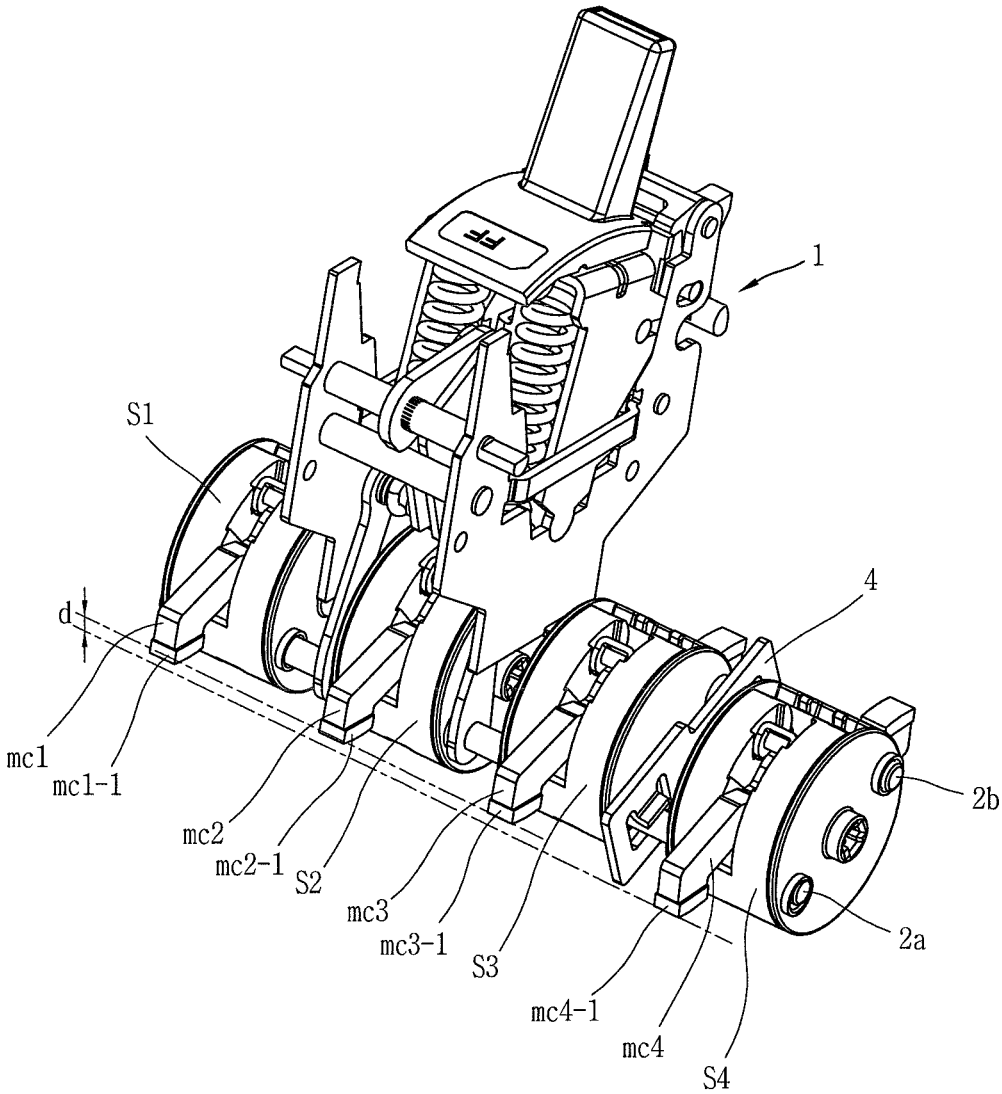
FIG. 5 is a perspective view of a shaft, a movable contactor, a pair of rotation pin, a rotation pin correction mechanism, and a switching mechanism for each pole for a four poles mold cased circuit breaker illustrating a structural feature in which the movable contactor of the neutral pole provided with a rotation pin correction mechanism for a four poles mold cased circuit breaker according to the present disclosure is provided to be more approached toward the corresponding stationary contactor than the movable contactors of other poles.

More specifically, referring to FIG. 5 illustrating only shafts for each pole S1, S2, S3, S4, movable contactors for each pole mc1, mc2, mc3, mc4, and a switching mechanism 1 in a state that an external insulation case, an arc extinguishing mechanism, and a trip mechanism is removed in the single pole units of four poles 3*a*, 3*b*, 3*c*, 3*d*, a pair of rotation pins 2*a*, 2*b* are connected through shafts for each poles S1, S2, S3, S4 to rotatably drive the shafts for each poles S1, S2, S3, S4 at the same time, thereby switching a circuit.

The shafts for each poles S1, S2, S3, S4 support the corresponding movable contactors mc1, mc2, mc3, mc4 as illustrated in FIG. 5, and accordingly, the corresponding movable contactors mc1, mc2, mc3, mc4 are also rotated together by the rotation of the shafts for each poles S1, S2, S3, S4.

Referring to FIGS. 1 and 5, the switching mechanism 1 is connected to drive a pair of rotation pins 2*a*, 2*b*, and particularly, provided on the S-pole single pole unit (namely, S-phase single pole unit) 3*b* of the single pole units of four poles 3*a*, 3*b*, 3*c*, 3*d*. Here, though the switching mechanism 1 is not illustrated in detail and not given with a reference numeral, for instance, as known well, may include side plates to be a base plate and to accommodate and support elements constituting the switching mechanism 1, a handle to provide a means for the user's manual switching manipulation, a lever to support the handle, a trip spring to provide charged elastic energy as a driving force for a trip operation automatically breaking a circuit, a latch to retain elastic energy of the trip spring as a charged state or release for discharging, a latch holder for locking or releasing the latch, a nail for locking or releasing the latch holder, a crossbar to press the nail to rotate while being rotated by receiving a trigger pressure for trip operation from the trip mechanism, and an upper and lower links to transfer elastic energy of the trip spring to a pair of rotation pins 2*a*, 2*b*.

A rotation pin correction mechanism for a four poles mold cased circuit breaker according to the present disclosure may include a correction plate 4.

According to a preferred embodiment of the present disclosure, as illustrated in FIG. 1, a correction plate 4 constituting a rotation pin correction mechanism of the four poles mold cased circuit breaker may be provided on a portion of the pair of rotation pins 2*a*, 2*b* located between a single pole unit farthest away from the switching mechanism 1, i.e., N-pole single pole unit (namely, N-phase single pole unit) 3*d*, and a single pole unit adjacent thereto, i.e., T-pole single pole unit (namely, T-phase single pole unit) 3*c*.

Figure 2:
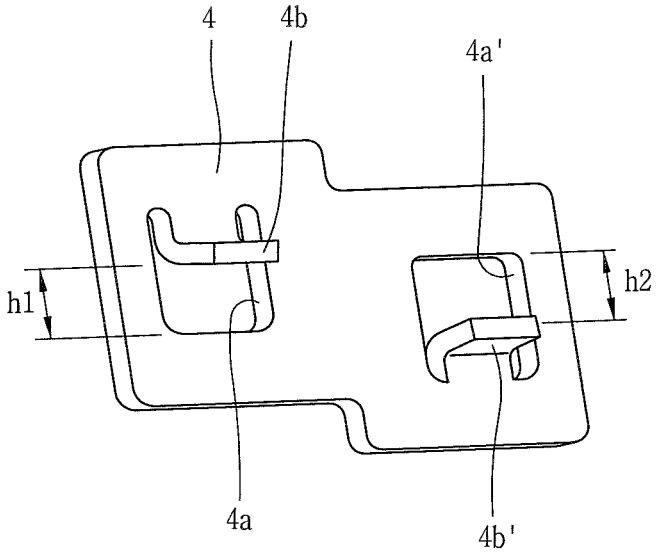
FIG. 2 is a perspective view illustrating that a rotation pin correction mechanism for a four poles mold cased circuit breaker according to the present disclosure is only separated apart.

According to a preferred embodiment of the present disclosure, as illustrated in FIG. 2, a correction plate 4 constituting a rotation pin correction mechanism of the four poles mold cased circuit breaker may include a pair of rotation pin through hole portions 4*a*, 4*a*', and a pair of adjustment extending portions 4*b*, 4*b*'. The correction plate 4 may be easily formed (produced) preferably by a pressing process.

The pair of rotation pin through hole portions 4*a*, 4*a*' allow a pair of rotation pins 2*a*, 2*b* to be penetrated therethrough, respectively.

The pair of adjustment extending portions 4*b*, 4*b*' are extended in the direction in which the rotation pins 2*a*, 2*b* penetrate at an upper or lower portion of the pair of rotation pin through hole portions 4*a*, 4*a*', and determine the heights h1, h2 of penetration allowance hole of the rotation pins 2*a*, 2*b* together with the rotation pin through hole portions 4*a*, 4*b*.

The correction plate 4 is preferably configured with a thin plate to easily install even at a narrow space between single pole units 3*a*, 3*b*, 3*c*, 3*d*.

Figure 3:
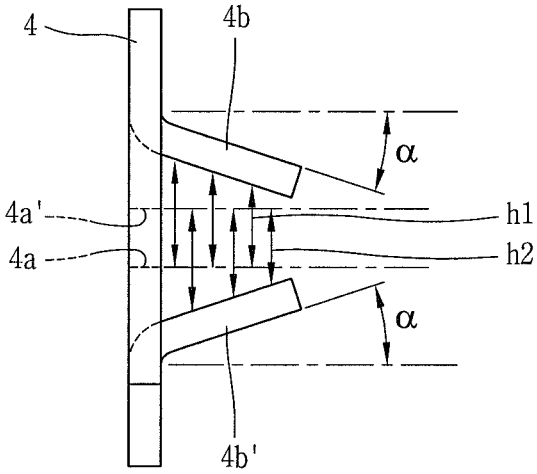
FIG. 3 is a side view illustrating a configuration in which an adjustment extending portion is slantly formed in a rotation pin correction mechanism for a four poles mold cased circuit breaker in FIG. 2.

Preferably, referring to FIG. 3 illustrating a side view of the correction plate 4, the adjustment extending portions 4*b*, 4*b*' of the correction plate 4 are formed to be slantly extended to gradually reduce the heights h1, h2 of penetration allowance hole of the rotation pins 2*a*, 2*b*. Here, an inclined angle at which the pair of adjustment extending portions 4*b*, 4*b*' are inclined from a surface perpendicular to a plate surface of the correction plate 4 has a predetermined inclined angle (α). Here, the inclined angle (α) may be selected in a different way depending on a correction amount of the rotation pins 2*a*, 2*b* or depending on whether to have an operation characteristic of fast-closing late-opening (its movable contact is first in contact with the corresponding fixed contact than the single pole units of other poles when it closes and last separated from the corresponding fixed contact than the single pole units of other poles when it opens) in the N pole single pole unit (N phase single pole unit) 3*d*. In other words, a large inclined angle (α) may be selected as increasing the correction amount of the rotation pins 2*a*, 2*b*, and a large inclined angle (α) may be selected when the N-pole single pole unit (namely, N-phase single pole unit) 3*d* has a characteristic of fast-closing late-opening in contrast to the single pole units of other poles. The selection of such an inclined angle (α) may be carried out by producing a correction plate 4 having various inclined angles (α) in advance and selecting the relevant correction plate 4 matched to its desired purpose.

When the N-pole single pole unit (namely, N-phase single pole unit) 3*d* has a characteristic of fast-closing late opening in contrast to the single pole units of other poles, referring to FIG. 5, the adjustment extending portions 4*b*, 4*b*' has an inclined angle (see FIG. 3) of the inclined extension for deforming the rotation pins 2*a*, 2*b* for the movable contact mc4-1 in the single pole unit of the neutral pole 3*d* farthest away from the switching mechanism 1 to be located at a more approached position to the corresponding stationary contact than a distance between the movable contacts mc1-1, mc2-1, mc3-1 in the single pole units of other poles and the corresponding stationary contacts.

On the other hand, the operation of a rotation pin correction mechanism for a four poles mold cased circuit breaker having the foregoing construction according to a preferred embodiment of the present disclosure will be described below with reference to FIGS. 1 through 6.

Figure 6:
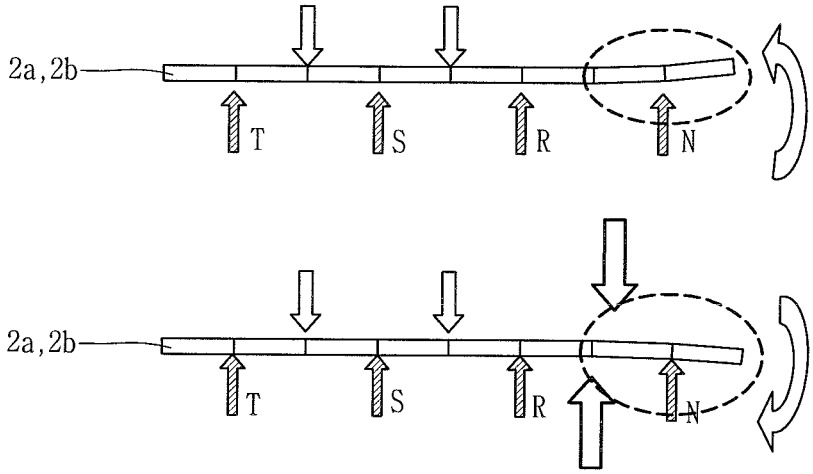
FIG. 6 is a comparison explanation view illustrating that a rotation pin deformation state when a rotation pin correction mechanism according to the present disclosure is not provided and when the rotation pin correction mechanism is provided for a rotation pin of a four poles mold cased circuit breaker.

In case where a rotation pin correction mechanism according to the present disclosure is not provided, referring to an upper portion of FIG. 6, when an upper pressure imposed to the rotation pins 2*a*, 2*b* by the contact of a contact is shown as a slashed line arrow, and a force imposed to the rotation pins 2*a*, 2*b* by the switching mechanism is shown as a downward arrow having a vacant inside, no deformation occurs in a portion between the T-pole single pole unit and the S-pole single pole unit of the rotation pins 2*a*, 2*b*, and between the S-pole single pole unit and the R-pole single pole unit thereof because the forces indicated by the slashed line arrow and the downward arrow having a vacant inside are in equilibrium. However, the downward arrow having a vacant inside which is a force imposed to the rotation pins 2*a*, 2*b* by the switching mechanism is very small and thus only the upper pressure imposed to the rotation pins 2*a*, 2*b* by the contact of a contact in the N-pole single pole unit exists, deformation bent upward as shown in a rotating arrow occurs at a portion of the N-pole single pole unit of the rotation pins 2*a*, 2*b*. Such deformation causes to make the contact of a contact in the N-pole single pole unit poor.

In case where a rotation pin correction mechanism according to the present disclosure is provided, referring to a lower portion of FIG. 6, a pressure (refer to a rotating block arrow) is imposed in a direction opposite to the deformation caused by a rotation pin correction mechanism of the present disclosure as shown in a large block-type arrow, and the pressure in the relevant opposite direction is larger than that of a force imposed to the rotation pins 2*a*, 2*b* by the contact of a contact in the N-pole single pole unit, and thus a portion of the rotation pins 2*a*, 2*b* adjacent to the N-pole single pole unit is infinitesimally bent in a direction opposite to the direction of being bent when the rotation pin correction mechanism is not provided. However, being bent in a direction opposite to the direction of being bent when the rotation pin correction mechanism is not provided may act as a positive effect acting such that the contact in the N-pole single pole unit has an operation characteristic of fast-closing late opening.

A method of providing a rotation pin correction mechanism for a four poles mold cased circuit breaker according to a preferred embodiment of the present disclosure will be described below with reference to FIGS. 1 through 4.

As illustrated in FIG. 1, the correction plate 4 is pressed to be inserted in a pair of rotation pins 2*a*, 2*b* to allow the pair of rotation pins 2*a*, 2*b* to be penetrated through the rotation pin through hole portions 4*a*, 4*a*' as illustrated in FIG. 2 in a state that the N-pole single pole unit (namely, N-phase single pole unit) 3*d* is separated from a pair of rotation pins 2*a*, 2*b*.

Here, referring to FIG. 3, the adjustment extending portions 4*b*, 4*b*' of the correction plate 4 are formed to be slantly extended to gradually reduce the heights h1, h2 of penetration allowance hole of the rotation pins 2*a*, 2*b*, thereby easily pressing the rotation pins 2*a*, 2*b* and correcting the deformation.

Figure 4:
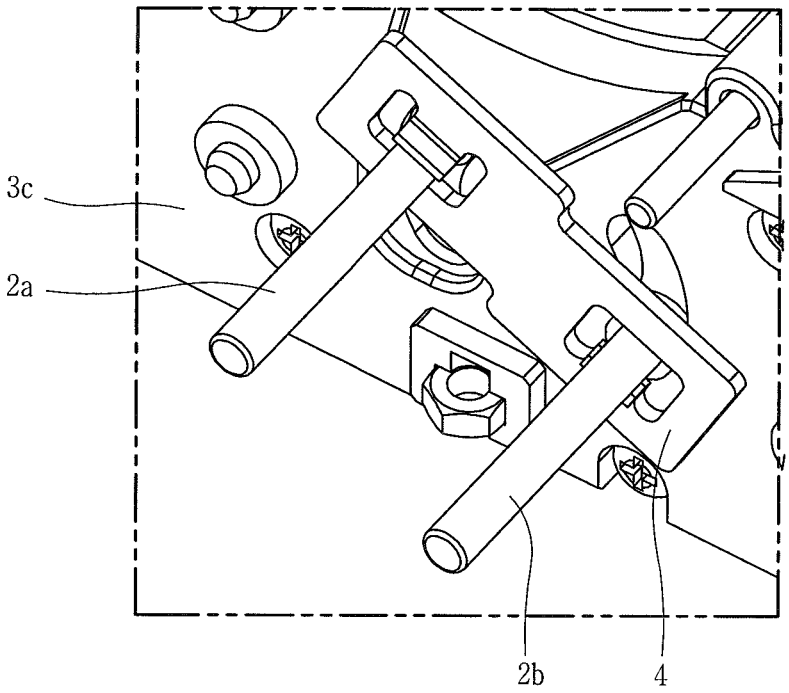
FIG. 4 is a partial enlarged perspective view of an operation state illustrating that rotation pins are corrected when a rotation pin correction mechanism for a four poles mold cased circuit breaker according to the present disclosure is provided.

In FIG. 4, the rotation pin 2*a* is pressed downward and the rotation pin 2*b* is pressed upward by the correction plate 4.

A rotation pin correction mechanism for a four poles mold cased circuit breaker according to the present disclosure has a configuration capable of correcting the deformation of the rotation pins 2*a*, 2*b* only by providing the correction plate 4 formed to have a pair of rotation pin through hole portions 4*a*, 4*a*' and a pair of adjustment extending portions 4*b*, 4*b*' at a portion of the pair of the rotation pins 2*a*, 2*b* located between the N-pole single pole unit (namely, N-phase single pole unit) 3*d* farthest away from the switching mechanism and the T-pole single pole unit (namely, T-phase single pole unit) 3*c* adjacent thereto. As a result, there is no process of manually adjusting a correction amount and thus the correction amount of the rotation pin may be uniform, and also it may be configured with one correction plate 4 without using a thick block, a screw and a nut, thereby obtaining an advantage that the correction mechanism can be installed even when a distance (space) between the single pole units is narrow.

In a rotation pin correction mechanism for a four poles mold cased circuit breaker according to the present disclosure, the correction plate 4 is configured with a thin plate, thereby providing an advantage that the correction mechanism can be easily installed even when a distance (space) between the single pole units is narrow.

In a rotation pin correction mechanism for a four poles mold cased circuit breaker according to the present disclosure, the adjustment extending portions 4*b*, 4*b*' are formed to be slantly extended to gradually reduce the heights h1, h2 of penetration allowance hole of the rotation pins 2*a*, 2*b*, and thus the insertion of the rotation pins 2*a*, 2*b* is facilitated when inserting the rotation pins 2*a*, 2*b* into the rotation pin through hole portions 4*a*, 4*a*' of the correction plate 4 for the first time and the height h1, h2 of penetration allowance hole of the rotation pins 2*a*, 2*b* is gradually reduced, thereby having an advantage that the rotation pins 2*a*, 2*b* are easily pressed to correct deformation.

In a rotation pin correction mechanism for a four poles mold cased circuit breaker according to the present disclosure, the adjustment extending portions 4*b*, 4*b*' has an inclined angle (α) of the inclined extension for deforming the rotation pins 2*a*, 2*b* for the movable contact mc4-1 in the single pole unit of the neutral pole 3*d* farthest away from the switching mechanism 1 to be located at a more approached position to the corresponding stationary contact than a distance between the movable contacts mc1-1, mc2-1, mc3-1 in the single pole units of other poles and the corresponding stationary contacts, and therefore, the movable contact mc4-1 in the N-pole single pole unit (namely, N-phase single pole unit) 3*d* is first in contact with the corresponding stationary contact when it closed and is last separated from the corresponding stationary contact when it opened compared to the movable contacts mc1-1, mc2-1, mc3-1 in the single pole units 3*a*, 3*b*, 3*c* of other poles, thereby obtaining an advantage that a safe ground state without ground-fault current or leakage current can be secured all the time according to the fast-closing late opening of the neutral pole.

What is claimed is:

1. A circuit breaker comprising:

four single pole units, each single pole unit including a movable contact, a stationary contact, and a rotatable member connected to the movable contact, the rotatable member including a first opening and a second opening;

a switching mechanism that provides force for moving the movable contacts into a contacting position with the stationary contacts and maintaining the contact position;

a pair of rotation pins that concurrently transfer force from the switching mechanism to the rotatable members, the pair of rotation pins including a first rotation pin positioned in the first openings of the rotatable members and a second rotation pin positioned in the second openings of the rotatable members, wherein the first rotation pin applies force in a first direction to a surface of each rotatable member within the first opening, and the second rotation pin applies force in a second direction to a surface of each rotatable member within the second opening; and a plate positioned between one of the single pole units farthest away from the switching mechanism and one of the single pole units adjacent thereto, the plate including a first surface, a first hole in the first surface, a second hole in the first surface, a first portion that extends from the first surface away from the plate, and a second portion that extends from the first surface away from the plate, wherein the first rotation pin is positioned in the first hole, the first portion applies a first pressure in the first direction to the first rotation pin, the second rotation pin is positioned in the second hole, and the second portion applies a second pressure in the second direction to the second rotation pin.

2. The circuit breaker of claim 1, wherein the plate is configured as a thin plate.

3. The circuit breaker of claim 1, wherein the first portion includes a first substantially planar surface extending at a first angle from the first surface such that the first substantially planar surface extends over a part of the first hole and contacts the first rotation pin to apply the first pressure, and the second portion includes a second substantially planar surface extending at a second angle from the first surface such that the second substantially planar surface extends over a part of the second hole and contacts the second rotation pin to apply the second pressure.

4. The circuit breaker of claim 3, wherein the first and second pressures deform, respectively, the first and second the rotation pins such that a distance between the movable contact and the stationary contact in the single pole unit farthest away from the switching mechanism is less than a distance between the movable contact and the stationary contact in each of the other single pole units.

5. The circuit breaker of claim 3, wherein the first angle is equal to the second angle.

6. The circuit breaker of claim 1, wherein the plate is a plate formed by a pressing process.

7. The circuit breaker of claim 1, wherein the first direction is opposite to the second direction.

* * * * *